US007526226B2

(12) United States Patent
Ito et al.

(10) Patent No.: US 7,526,226 B2
(45) Date of Patent: Apr. 28, 2009

(54) IMAGE FORMING APPARATUS HAVING LOWERED IMAGE FORMING POSITION AND RECESSED SHEET STACKING PORTION

(75) Inventors: Sakae Ito, Nishikasugai-gun (JP); Shusaku Tsusaka, Nagoya (JP); Yasuo Tamaru, Nagoya (JP); Tomitake Aratachi, Nagoya (JP); Terumasa Ito, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 164 days.

(21) Appl. No.: 11/090,989

(22) Filed: Mar. 28, 2005

(65) Prior Publication Data

US 2005/0220479 A1 Oct. 6, 2005

(30) Foreign Application Priority Data

Mar. 31, 2004 (JP) ..... 2004-105504

(51) Int. Cl.
*G03G 15/00* (2006.01)
*G03G 21/18* (2006.01)

(52) U.S. Cl. ..... 399/107; 399/124

(58) Field of Classification Search ..... 399/107, 399/110, 111, 113, 118, 119, 122, 124, 125, 399/361, 405
See application file for complete search history.

(56) References Cited

U.S. PATENT DOCUMENTS

| | | | | |
|---|---|---|---|---|
| 6,015,148 | A | 1/2000 | Cho | |
| 6,078,764 | A | 6/2000 | Akutsu | |
| 6,311,026 | B1 | 10/2001 | Higeta et al. | |
| 6,385,414 | B1 | 5/2002 | Sato et al. | |
| 2003/0095808 | A1 * | 5/2003 | Takami | 399/71 |
| 2003/0175042 | A1 | 9/2003 | Nishimura | |
| 2003/0235428 | A1 * | 12/2003 | Suzuki et al. | 399/107 |

FOREIGN PATENT DOCUMENTS

| | | |
|---|---|---|
| JP | A-59-045466 | 3/1984 |
| JP | A 59-045466 | 3/1984 |
| JP | U 59-173638 | 11/1984 |
| JP | A-04-171474 | 6/1992 |
| JP | A 04-329557 | 11/1992 |
| JP | A-04-329557 | 11/1992 |
| JP | A 05-297649 | 11/1993 |
| JP | A 06-106819 | 4/1994 |
| JP | A 06-308793 | 11/1994 |

(Continued)

*Primary Examiner*—Hoang Ngo
(74) *Attorney, Agent, or Firm*—Oliff & Berridge, PLC

(57) ABSTRACT

An image forming apparatus includes a main casing; a photosensitive member; a process cartridge that can be installed or removed with respect to the main casing along a removal path; a pick-up roller located above a sheet accommodating portion; and a feed path along which a sheet can be conveyed from the sheet accommodating portion to a discharge port. At least a part of the feed path is substantially parallel to the removal path and located between the sheet accommodating portion and the process cartridge when the process cartridge is installed in the main casing; and an image forming position where an image is transferred from the photosensitive member to the sheet is located along the feed path at a position lower than an upper surface of the pick-up roller in a verticle direction.

22 Claims, 3 Drawing Sheets

FOREIGN PATENT DOCUMENTS

| | | |
|---|---|---|
| JP | A 07-244410 | 9/1995 |
| JP | A 08-30180 | 2/1996 |
| JP | A 09-185201 | 7/1997 |
| JP | A 9-185202 | 7/1997 |
| JP | A-09-222843 | 8/1997 |
| JP | A 10-072174 | 3/1998 |
| JP | A 10-254327 | 9/1998 |
| JP | A-11-146112 | 5/1999 |
| JP | A 11-155034 | 6/1999 |
| JP | A 11-202734 | 7/1999 |
| JP | A 2000-147960 | 5/2000 |
| JP | A 2000-347472 | 12/2000 |
| JP | A 2001-001608 | 1/2001 |
| JP | A 2001-042586 | 2/2001 |
| JP | A 2001-100493 | 4/2001 |
| JP | A 2001-100550 | 4/2001 |
| JP | A-2001-175123 | 6/2001 |
| JP | A 2001-175123 | 6/2001 |
| JP | A 2001-282075 | 10/2001 |
| JP | A 2002-062711 | 2/2002 |
| JP | A 2002-162865 | 6/2002 |
| JP | A 2003-271030 | 9/2003 |

* cited by examiner

IMAGE FORMING APPARATUS HAVING LOWERED IMAGE FORMING POSITION AND RECESSED SHEET STACKING PORTION

CROSS-REFERENCE TO RELATED APPLICATIONS

This application claims priority from JP 2004-105504, filed Mar. 31, 2004, the disclosure of which is incorporated herein by reference in its entirety.

BACKGROUND

Known image forming apparatuses form an image by developing an electrostatic latent image formed on a photosensitive member with toner. For example, in the image forming apparatus disclosed in JP-A-2003-271030, sheets are fed one-by-one by a pick-up roller to a sheet feed path from a sheet accommodating portion disposed on a lower part of the image forming apparatus. An image is formed on the sheet while the sheet is being fed along the sheet feed path. After image formation, the sheet is discharged onto a discharge tray provided on an upper part of the image forming apparatus.

The image forming apparatus includes a process unit having a photosensitive member and a toner tank, a scanner unit having a polygon mirror for forming an electrostatic latent image on the photosensitive member with a scanning laser beam, and a fixing unit for thermally fixing a visible toner image transferred from the photosensitive member to a sheet.

In the vicinity of the pick-up roller, the sheet accommodating portion, the pick-up roller, the process unit, and the scanner unit are disposed in a stacked manner in a direction corresponding to the height of the image forming apparatus.

In the vicinity of the fixing unit, the sheet accommodating portion, the fixing unit, and the discharge tray are disposed in a stacked manner in the direction corresponding to the height of the image forming apparatus.

In the image forming apparatus, the process unit is moved in a substantially horizontal direction when removed from the image forming apparatus, passing through a space between the pick-up roller and the scanner unit. Such removal might occur, for example, when an amount of toner remaining in the toner tank becomes small, so that the process unit can be replaced.

Because the sheet accommodating portion, the pick-up roller, the process unit, and the scanner unit are disposed in a stacked manner, the image forming apparatus must have a height greater than the stacked height of the sheet accommodating portion, the pick-up roller, the process unit, and the scanner unit. Consequently, this limitation on the minimum height of the image forming apparatus prevents reductions in the overall size of the image forming apparatus.

Likewise, the stacked arrangement of the sheet accommodating portion, the fixing unit, and the discharge tray places an undesirable limitation on the minimum height of the image forming apparatus.

Significant changes in the arrangement of the above-described components in the image forming apparatus to reduce the overall height of the image forming apparatus can necessitate the inclusion of additional components and may cause removal of the process unit to be difficult.

SUMMARY

Accordingly, in various exemplary embodiments, an image forming apparatus capable of forming an image by developing an electrostatic latent image formed on a photosensitive member is provided, in which increases in the height of the image forming apparatus are prevented without significantly changing the arrangement of a sheet accommodating portion, a pick-up roller, a process unit, a scanner unit, a fixing unit and a discharge tray in the image forming apparatus.

In various exemplary embodiments, an image forming apparatus includes: a main casing; a photosensitive member; a process cartridge that can be installed or removed with respect to the main casing along a removal path, the process cartridge including a developer accommodating portion that can accommodate a developer; a scanner unit located above the process cartridge when the process cartridge is installed in the main casing, the scanner unit being capable of irradiating a surface of the photosensitive member with a laser beam; a sheet accommodating portion located at a bottom portion of the main casing, the sheet accommodating portion being capable of accommodating a sheet; a pick-up roller located above the sheet accommodating portion, the pick-up roller being capable of drawing the sheet from the sheet accommodating portion; and a feed path along which the sheet can be conveyed from the sheet accommodating portion to a discharge port. In various exemplary embodiments, at least a part of the feed path is substantially parallel to the removal path and located between the sheet accommodating portion and the process cartridge when the process cartridge is installed in the main casing; the scanner unit includes a frame including a first portion having a first height and a second portion having a second height that is less than the first height, the second portion being located closer to the pick-up roller than the first portion; and an image forming position where an image is transferred from the photosensitive member to the sheet is located along the feed path at a position lower than an upper surface of the pick-up roller in a vertical direction.

In various exemplary embodiments, an image forming apparatus includes a sheet accommodating portion located at a bottom portion of a main casing of the image forming apparatus, the sheet accommodating portion being capable of accommodating a sheet; a feed path along which the sheet can be conveyed from the sheet accommodating portion to a discharge port, at least a part of the feed path being located between the sheet accommodating portion and a process cartridge when the process cartridge is installed in the main casing; a fixing unit including a heat roller that is capable of heating a developer after the developer is transferred onto the sheet; the discharge port through which the sheet can be discharged after the developer is fixed onto the sheet by the fixing unit, the discharge port being located on an upper portion of the image forming apparatus; and a sheet stacking portion on which the sheet can be stacked after the sheet is discharged through the discharge port. In various exemplary embodiments, the sheet stacking portion includes a recess such that a bottom surface of the sheet stacking portion at a position adjacent to the discharge port is lower than an upper surface of the fixing unit.

These and other optional features and possible advantages of various aspects of this invention are described in, or are apparent from, the following detailed description of exemplary embodiments of systems and methods which implement this invention.

BRIEF DESCRIPTION OF THE DRAWINGS

Various exemplary embodiments of the invention will be described in detail with reference to the following figures, wherein.

DETAILED DESCRIPTION OF EMBODIMENTS

Figure 1:
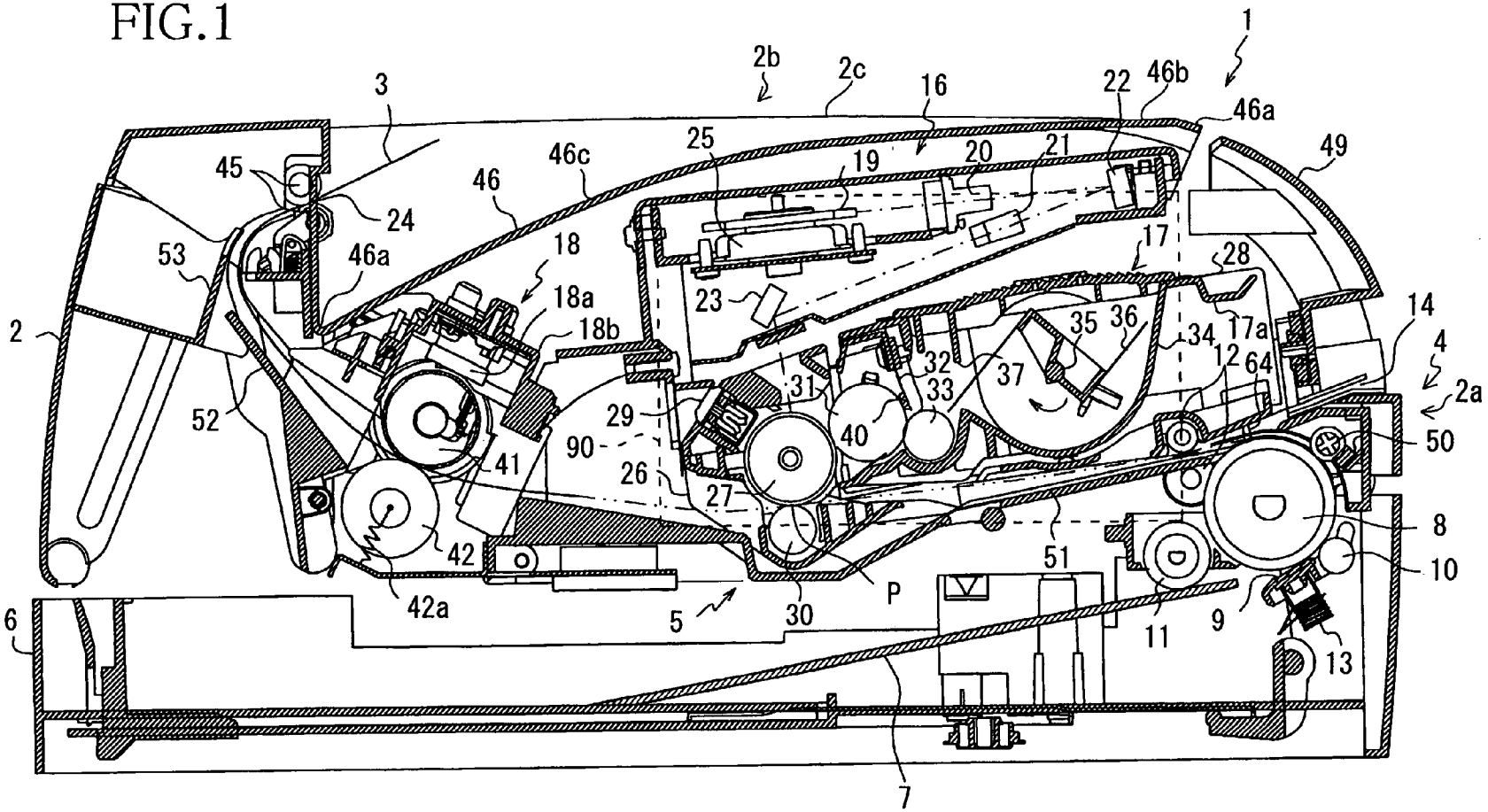
FIG. 1 is a side cross sectional view of an exemplary image forming apparatus according to this invention.

Throughout the following description, numerous specific concepts and structures are set forth in order to provide a thorough understanding of the invention. The invention can be practiced without utilizing all of these specific concepts and structures. In other instances, well known elements have not been shown or described in detail, so that emphasis can be focused on the invention.

In various exemplary embodiments, an image forming apparatus may include: a main casing; a photosensitive member; a process cartridge that can be installed in or removed from the main casing, the process cartridge including a developer accommodating portion that accommodates a developer; a scanner unit provided above the process cartridge when the process cartridge is attached to the main casing that irradiates a surface of the photosensitive member with a laser beam; a recording medium accommodating portion provided at a bottom of the main casing that accommodates a recording medium; a pick-up roller provided above the recording medium accommodating portion, the pick-up roller picking up the recording medium in the recording medium accommodating portion; and a feed path formed between the recording medium accommodating portion and the process cartridge when the process cartridge is installed in the main casing.

In various exemplary embodiments, the process cartridge may be installed in and removed from the main casing in a direction substantially parallel to the feed path. The scanner unit may include a frame having a first height at a first portion and a second height that is less than the first height at a second portion. The second portion may be positioned adjacent to the pick-up roller. The first portion may be positioned away from the pick-up roller in a direction substantially parallel to the feed path. At least a part of the feed path may be formed along a direction substantially parallel to a direction in which the process cartridge is installed in and removed from the main casing. Further, at least a part of the feed path may be formed between the process cartridge and the recording medium accommodating portion when the process cartridge is installed in the main casing. An image forming position may be located along the feed path at a position that is lower than an upper end of the pick-up roller in a direction perpendicular to the direction in which the process cartridge is installed in and removed from the main casing.

An image forming apparatus may have a minimum height that corresponds to a total height of a recording medium accommodating portion, a pick-up roller, a process cartridge and a scanner unit. The thickness of components disposed directly above the pick-up roller may have the greatest effect on the overall height of the image forming apparatus. In various exemplary embodiments, to reduce the height of an image forming apparatus, the thickness of components disposed directly above a pick-up roller may be reduced as much as possible. Other components of the image forming apparatus may be disposed at areas other than an area directly above the pick-up roller to effectively use space in a height direction of the image forming apparatus. A process cartridge (one of the components of the image forming apparatus) may be configured in a manner that permits the cartridge to be installed or removed in a substantially horizontal direction when passing above the pick-up roller.

In various exemplary embodiments, a scanner unit of an image forming apparatus may be formed in a tapered shape along a direction in which a process cartridge is installed in and removed from the image forming apparatus, so that a thickness of the scanner unit on a side closest to a pick-up roller is reduced to accommodate installation and removal of the process cartridge.

In various exemplary embodiments, a part of a feed path of an image forming apparatus may be formed in an area between a process cartridge and a recording medium accommodating portion, and an image forming position along the feed path may be provided in a position lower than an upper end of a pick-up roller.

Accordingly, embodiments of the present invention include an image forming apparatus, in which installation and removal of a process cartridge may be readily performed. Further, a height of the image forming apparatus at a location of a pick-up roller may be reduced as compared to image forming apparatuses including scanner units that are not formed in a tapered shape.

In various exemplary embodiments, a position of a process cartridge in an image forming apparatus may be lowered by an amount corresponding to an amount that an image forming position is lowered with respect to an upper end of a pick-up roller. Accordingly, the overall height of the image forming apparatus at the image forming position may be reduced.

In various exemplary embodiments, a process cartridge includes a photosensitive member, allowing the photosensitive member to be replaced when the process cartridge is replaced. In various exemplary embodiments, a process cartridge may include a transfer roller that transfers a visible image from a photosensitive member to a recording medium. Including the transfer roller in the process cartridge permits the transfer roller to be replaced when the process cartridge is replaced. Including the transfer roller in the process cartridge may cause the height of the process cartridge to be increased. However, according to the present invention, it possible to install and remove the process cartridge without increasing the overall height of the image forming apparatus.

In various exemplary embodiments, a scanner unit of an image forming apparatus may include an upper plate and a lower plate. The lower plate may be positioned at a greater angle with respect to horizontal than the upper plate. Thus, the height of the image forming apparatus at a position near a pick-up roller may be reduced.

In various exemplary embodiments, a scanner unit of an image forming apparatus may include a laser diode that emits a laser beam, a polygonal mirror that reflects the laser beam from the laser diode, a motor that rotates the polygonal mirror, a first mirror that reflects the laser beam from the polygonal mirror, and a second mirror that reflects the laser beam from the first mirror. The first mirror may be positioned adjacent to a front wall of the scanner unit. The second mirror, the polygonal mirror and the motor may positioned adjacent to a rear wall of the scanner unit.

According to embodiments of the present invention, a scanner unit of an image forming apparatus may be formed in a tapered shape having a smaller height on a side closest to a pick-up roller, so that the height of the image forming apparatus at a position near the pick-up roller may be reduced.

In various exemplary embodiments, a feed path of an image forming apparatus may be inclined downwardly continuously from an upper surface of a pick-up roller to an image forming position. By employing such a configuration, an area above the feed path between the pick-up roller and the image forming position may be effectively used, and in turn, the size of the image forming apparatus may be reduced.

In an exemplary process cartridge for an image forming apparatus, a photosensitive member and a developer accommodating portion will have a large height and will occupy a large space, as compared with other components of the image forming apparatus. Accordingly, in embodiments, the image forming apparatus may be configured so that the photosensitive member and the developer accommodating portion are not disposed directly above a roller for feeding a recording medium, to the extent possible. More specifically, the process cartridge may be located on a removal path, by which the process cartridge is installed in and removed from the image forming device, closer to the image forming position than to a position directly above the pick-up roller. In a case where a register roller is disposed on the feed path between the pick-up roller and the image forming position, the process cartridge may be located on the removal path closer to the image forming position than to a position directly above the register roller. By employing such a structure, the photosensitive member and the developer accommodating portion may be configured so that they do not overlap with the pick-up roller and/or the register roller. Thus, the image forming apparatus may be reduced in size, while allowing for the respective sizes of the photosensitive member and the developer accommodating portion of the process cartridge.

In various exemplary embodiments, a scanner unit of an image forming apparatus may be formed in a tapered shape having a smaller height on a side closest to a pick-up roller. So that the image forming apparatus may have a constant thickness, even at the tapered portion of the scanner unit, the scanner unit may be located on a removal path, by which the process cartridge is installed in and removed from the image forming device, closer to the image forming position than to a position directly above the pick-up roller. By employing such a configuration, the scanner unit will not overlap with the pick-up roller. Accordingly, the height of the image forming apparatus at the position of the pick-up roller may be reduced.

In various exemplary embodiments, an image forming apparatus may include a heat roller, a discharge roller and a guide located along the feed path. The heat roller heats developer transferred onto a recording medium. The discharge roller discharges the recording medium from the image forming apparatus through a discharge port and is disposed near the discharge port. The guide guides the recording medium along an interval of the feed path between the heat roller and the discharge roller. In various exemplary embodiments, the interval between the heat roller and the discharge roller may be shorter than a minimum length of the recording medium in a feeding direction. By employing such a configuration, it may not be necessary to provide additional rollers, and the image forming apparatus may be reduced in size.

To reduce the size of an image forming apparatus, a recording medium may be discharged through a discharge port, by bending the recording medium along a curved portion of the feed path immediately after the recording medium passes through the heat roller. However, if the recording medium is bent immediately after passing through the heat roller, the recording medium may be left in a bent shape after the recording medium is discharged through the discharge port. Accordingly, in exemplary embodiments, a curvature of a guide, which forms the feed path near the discharge roller, may be greater than a curvature of the feed path near the heat roller. By employing such a configuration, the discharge roller can occupy a lower position, while bending of the recording medium can be effectively prevented.

In various exemplary embodiments, a feed path of an image forming apparatus may have a shape such that a recording medium is turned at a position near a pick-up roller and turned again at a position downstream of an image forming position in a direction that the recording medium is fed through the image forming apparatus. The feed path may be formed to be substantially "S"-shaped when viewed from an axial direction of the pick-up roller. By employing such a configuration, a long feed path, relative to the size of the image forming apparatus, may be formed. Accordingly, components of the image forming apparatus that are to be disposed in the vicinity of the feed path may be efficiently arranged.

In various exemplary embodiments, an image forming apparatus may include a fixing unit, a discharge port and a recording medium stacking portion. The fixing unit may include a heat roller that heats developer that has been transferred onto a recording medium. The discharge port may provide an opening through which the recording medium on to which developer has been fixed can be discharged on to an upper portion of the image forming apparatus. The recording medium stacking portion may be a location at which recording media that have been discharged from the discharge port may be stacked. In this case, the recording medium stacking portion may be preferably provided with a recess causing a bottom surface of the recording medium stacking portion on a side near the discharge port, to be lower than an upper face of the fixing unit. By employing such a configuration, a recess of the recording medium stacking portion may be formed at a position lower than an upper face of the fixing unit. Accordingly, the discharge port may be disposed at a relatively low position without reducing the quantity of recording media that can be stacked in the recording medium stacking portion. Thus, the height of the image forming apparatus at a position near the discharge port may be reduced.

In various exemplary embodiments, a fixing unit of an image forming apparatus may include a heating element that is heated by a power application, a switching device that switches off the power application to the heating element at a predetermined temperature and is disposed above the heat roller, and a pressing roller that is pressed toward a rotating axis of the heat roller and is disposed on a side opposite a pick-up roller and directly below the heat roller. The switching device may be located substantially in a plane perpendicular to a plane including the rotating axis of the heat roller and a rotating axis of the pressing roller. Because the switching device may sense heat that the heat roller gives off, the switching device may be disposed above the heat roller. However, if the switching device is disposed directly above the heat roller or at a downstream side of a position directly above the heat roller in a direction that the recording medium is fed (that is, a side of the heat roller opposite from the pick-up roller), the position of a recess of a recording medium stacking portion may be disposed at a higher position. Therefore, the switching device may be located substantially in a plane perpendicular to a plane including the rotating axis of the heat roller and a rotating axis of the pressing roller. By employing such a structure, the recess of the recording medium stacking portion may be disposed at a lower position. Thus, the overall height of the image forming apparatus may be reduced.

In various exemplary embodiments, a fixing unit of an image forming apparatus may include a cover that covers a heat roller and a switching device, but that leaves a pressing roller exposed. The cover may support the switching device substantially in a plane perpendicular to a plane including the rotating axis of the heat roller and a rotating axis of the pressing roller. By employing such a structure, a fixing unit can be provided that does not include a cover at a lower part of the fixing unit. Thus, the height of the image forming apparatus may be reduced by the thickness of such a cover, had such a cover been used.

In various exemplary embodiments, an image forming apparatus may include a circuit board that electrically controls, components of the image forming apparatus and on which an electronic circuit may be mounted. The circuit board may be disposed at one side of the image forming apparatus substantially in a vertical plane, the vertical plane being perpendicular to a plane including a rotating axis of the photosensitive member and a rotating axis of the pick-up roller. By employing such a structure, a thickness of the circuit board will not be reflected in the overall height of the image forming apparatus. Accordingly, the overall height of the image forming apparatus may be reduced in comparison with an image forming apparatus in which a circuit board is arranged substantially horizontally.

In various exemplary embodiments, a charger may be provided on a process cartridge of an image forming apparatus. A photosensitive member of the process cartridge may have a cylindrical shape extending in a direction perpendicular to a removal path (e.g., a direction in which the process cartridge is installed in or removed from the image forming device). The charger may be located in a position about 45 degrees from horizontal with respect to the photosensitive member. By employing such a structure, the charger will not project upwardly from an upper end of the photosensitive member. Accordingly, the position of the charger will not adversely affect the height of the image forming apparatus.

In various exemplary embodiments, an ejection roller of an image forming apparatus discharges recording media accommodated in a recording medium accommodating portion to a position where a pick-up roller is capable of drawing or feeding the recording media. A separation pad may be provided that allows only the uppermost recording medium in the recording medium accommodating portion to be drawn or fed, when a plurality of recording media are fed by the ejection roller. The separation pad may be provided near the position where the pick-up roller can draw or feed recording media. By employing the ejection roller, a load applied to the separation pad by the recording medium may be reduced, so that wear of the separation pad and the recording medium may be prevented.

In various exemplary embodiments, an image forming apparatus may include: a recording medium accommodating portion provided at a bottom of a main casing that accommodates a recording medium; a feed path formed between the recording medium accommodating portion and a process cartridge when the process cartridge is attached to the main casing; a fixing unit including a heat roller that heats a developer that has been transferred onto the recording medium; a discharge port through which the recording medium having developer fixed thereon is discharged to an upper portion of the image forming apparatus; and a recording medium stacking portion provided at an upper portion of the image forming apparatus on to which discharged recording media may be stacked. The recording medium stacking portion may be provided with a recess so that a bottom surface of the recording medium stacking portion is positioned lower than an upper face of the fixing unit at an end nearest to the discharge port. By employing such a structure, the discharge port may be disposed at a relatively low position without reducing the quantity of recording media that can be stacked in the recording medium stacking portion. Accordingly, the height of the image forming apparatus at a position near the discharge port may be reduced.

In various exemplary embodiments, a heat roller that heats developer transferred onto a recording medium, a discharge roller that discharges the recording medium from an image forming apparatus through a discharge port and is disposed near the discharge port, and a guide that guides the recording medium over an interval between the heat roller and the discharge roller may be form a portion of a feed path of the image forming apparatus. The interval between the heat roller and the discharge roller may be shorter in length than a minimum length of the recording medium in direction that the recording medium is fed through the image forming apparatus. By employing such a structure, additional rollers need not be provided in the feed path between the heat roller and the discharge roller, saving space, and in turn, allowing the image forming apparatus to be reduced in size.

In various exemplary embodiments, a guide of a feed path of an image forming apparatus may be formed in a curved shape so that a recording medium that has passed a heat roller is bent. A curvature of the guide near the discharge roller may be greater than a curvature of the guide near the heat roller. By employing such a structure, a position where the discharge roller is disposed may be lowered while effectively preventing the recording medium from being bent.

In various exemplary embodiments, a fixing unit of an image forming apparatus may include a heating element that is heated by a power application, a switching device that switches off the power application to the heating element at a predetermined temperature and is disposed above the heat roller, and a pressing roller that is pressed toward a rotating axis of the heat roller and is disposed on a side opposite to the pick-up roller with respect to a position directly below the heat roller. The switching device may be located substantially in a plane perpendicular to a plane including the rotating axis of the heat roller and a rotating axis of the pressing roller. By employing such a structure, a recess of a recording medium stacking portion may be disposed at a lower position so that the height of the image forming apparatus may be reduced.

In various exemplary embodiments, a fixing unit of an image forming apparatus may include a cover that covers a heat roller and a switching device while leaving a pressing roller exposed. The cover may support the switching device substantially in a plane perpendicular to a plane including the rotating axis of the heat roller and a rotating axis of the pressing roller. By employing such a structure, a cover may be provided that is not disposed at a lower part of the fixing unit. Thus, the height of the image forming apparatus may be reduced by the thickness of such a cover, had such a cover been used.

FIG. 1 shows a side cross sectional view of a printer 1. The right side of FIG. 1 is referred to as the front side of the printer 1 and the left side of FIG. 1 is referred to as the rear side of the printer 1. As shown in FIG. 1, the printer 1 is provided in a main casing 2 with a feeder portion 4 for feeding a recording medium or sheet 3 (e.g., paper) and an image forming portion 5 for forming an image on the fed sheet 3. Disposed in an upper portion of the printer 1 is a discharge tray 46 that is used to hold the discharged sheet 3 having an image formed thereon by the printer 1. A front cover 49 is disposed on a front side face (front face) 2*a* of the printer 1.

The feeder portion 4 includes a sheet cassette 6, a sheet mounting plate 7 arranged within the sheet cassette 6, an ejection roller 11 arranged above one end portion of the sheet cassette 6, a pick-up roller 8, a separation pad 9, a pinch roller 10 opposing the pick-up roller 8, a sheet powder removing roller 50, and register rollers 12 arranged downstream of the sheet powder removing roller 50 in a sheet feeding direction.

The sheet cassette 6 is removably installed in a bottom portion of the main casing 2 and is used to accommodate a stack of the sheets 3 in the sheet cassette 6. The sheet cassette 6 is pulled out toward the front side of the printer 1 (right side in FIG. 1) when the sheets 3 are added to the sheet cassette 6. As the sheet cassette 6 is pulled out, the feeder portion 4 is divided at a position between the pick-up roller 8 and the separation pad 9, so that the pinch roller 10, the separation pad 9 and a spring 13 arranged on a back side of the separation pad 9 are pulled out together with the sheet cassette 6.

The sheet mounting plate 7 is pivotally supported on an end far from the pick-up roller 8, so that the other end of the sheet mounting plate 7 near the pick-up roller 8 can be moved in a vertical direction. The sheet mounting plate 7 is urged upwardly by a spring (not shown). As the amount of the sheets 3 stacked on the sheet mounting plate 7 increases, the sheet mounting plate 7 pivots downward about the end away from the pick-up roller 8 against an urging force of the spring.

The ejection roller 11 is disposed so as to contact the uppermost sheet 3 stacked on the sheet mounting plate 7 in the sheet cassette 6. The ejection roller 11 feeds the sheet 3 to a position where the pick-up roller 8 can feed the sheet 3, that is, to a position between the pick-up roller 8 and the separation pad 9.

The separation pad 9 is arranged in confrontation with the pick-up roller 8. The separation pad 9 is pressed toward the pick-up roller 8 by the spring 13 arranged on the back side of the separation pad 9. The separation pad 9 has a function of preventing plural sheets 3 from being supplied in an overlapping state into a sheet feed path (shown by the two-dotted chain line in FIG. 1). More specifically, the sheet 3 sent by the ejection roller 11 comes into contact with the pick-up roller 8 and the separation pad 9. At this time, some frictional force is applied between the separation pad 9 and the sheet 3. Accordingly, even when plural sheets 3 are sent by the ejection roller 11 to the separation pad 9, the sheets 3 other than the uppermost sheet 3 are stopped by the separation pad 9. Therefore, sheets 3 are supplied one at a time from the pick-up roller 8.

The sheet 3 fed by the pick-up roller 8 is sent to the sheet feed path. At this time, sheet powder or fibers are removed from the sheet 3 by the sheet powder removing roller 50. Then, the sheet 3 is fed to the register rollers 12. The sheet feed path is formed downward, with respect to the horizontal direction, at the entire interval from the upper end of the pick-up roller 8 to an image forming position P. Most of the sheet feed path between the pick-up roller 8 and the image forming position P is formed by a guide member 51 provided on the main casing 2 and by a bottom of a process unit 17.

The pick-up roller 8 sends the sheet 3 to the register rollers 12 by turning the sheet 3 about 180 degrees. When curvature for curving or turning the sheet 3 by the pick-up roller 8 is large and the sheet 3 is of thick material, such as a postcard, the sheet 3 may possibly be bent or may not be conveyed downstream to the register rollers 12 due to the resistance applied when the sheet 3 is bent.

Accordingly, the diameter of the pick-up roller 8 is set larger than rollers, such as a photosensitive drum 27 and a heat roller 41. More specifically, the diameter of the pick-up roller 8 may be about 33 mm in embodiments where the diameter of the photosensitive drum 27 is about 24 mm and the diameter of the heat roller 41 is about 25 mm. As the diameter of the pick-up roller 8 is relatively large and the curvature that would result in bending the sheet 3 is small, the sheet 3 can be conveyed by the pick-up roller 8 without bending the sheet 3.

The register rollers 12 include a pair of rollers. Operation of the register rollers 12 is controlled by a controller (not shown) arranged within a circuit board 90 (described below), based on a signal provided by a position sensor 64, which is arranged near the pick-up roller 8. Under such control, skew of the sheet 3 is corrected by the register rollers 12. More specifically, the controller sets the register rollers 12 to a driving state during sheet feeding by the pick-up roller 8, and stops the register rollers 12 when the position sensor 64 detects the leading edge of the sheet 3. Then, as the sheet 3 comes in contact with the register rollers 12 and slacks, the controller again drives the register rollers 12 and sends the sheet 3 to the image forming portion 5.

The position sensor 64 is of a mechanical type. When the position sensor 64 comes in contact with the sheet 3 and is pushed by the sheet 3, the position sensor 64 is moved from a predetermined position.

A manual feed slot 14 for directly feeding the sheet 3 from the front side of the printer 1 to the register rollers 12 is formed above the pick-up roller 8. Accordingly, the sheet 3 can be supplied to the sheet feed path without having been stored in the sheet cassette 6.

The image forming portion 5 includes a scanner unit 16, the process unit 17, and a fixing unit 18. The scanner unit 16 is arranged in an upper portion of the main casing 2. The scanner unit 16 has a laser light emitting portion (not shown), such as a laser diode, a polygon mirror 19 driven by a motor 25 so as to rotate lenses 20, 21 and reflecting mirrors 22, 23. As shown by the one-dotted chain line in FIG. 1, a laser beam emitted from the laser light emitting portion based on image data, passes through or reflects off the polygon mirror 19, the lens 20, the reflecting mirror 22, the lens 21 and the reflecting mirror 23 in this order to irradiate a surface of the photosensitive drum 27 of the process cartridge 17 with the laser beam at high speed.

More specifically, the polygon mirror 19 is arranged over the photosensitive drum 27 and the image forming position P. In the scanner unit 16, the laser beam reflected off the polygon mirror 19 is advanced toward the reflecting mirror 22 in a substantially horizontal direction. Then, the laser beam is reflected off the reflecting mirror 22 toward the reflecting mirror 23 located below the polygon mirror 19. The reflecting mirror 22 reflects the incident laser beam at an acute angle, so as to direct the incident laser beam downward by about 15 degrees, with respect to horizontal. The scanner unit 16, including the polygon mirror 19, the lenses 20, 21, and the reflecting mirrors 22, 23, has a size and shape that do not interfere with the optical path of the laser beam. Though substantially horizontal, an upper face (upper plate) of the scanner unit 16 is arranged so that an end away from the pick-up roller 8 is lower than the other end. A lower face (lower plate) of the scanner unit 16 is more severely inclined in comparison with the upper face, such that a portion far from the pick-up roller 8 is lower than the other end. Thus, the scanner unit 16 has a tapered shape, such that the image forming position P side at which the polygon mirror 19 is located is thick and the pick-up roller 8 side is thin.

The process unit 17 functioning as an imaging unit is arranged below the scanner unit 16. When the process unit 17 is installed in or removed from the main casing 2, the process unit 17 is moved substantially horizontally in forward and backward directions (left and right directions in FIG. 1—left to install and right to remove). The process unit 17 includes a drum cartridge 26 and a developing cartridge 28. A space is left between the process unit 17 and the scanner unit 16, when the process unit 17 is installed in the main casing 2.

The drum cartridge 26 of the process unit 17 includes the photosensitive drum 27, a scorotron charger 29 and a transfer roller 30.

The developing cartridge 28 includes a developing roller 31, a layer thickness regulating blade 32, a toner supply roller 33, and a toner box 34. The developing cartridge 28 is detachably installed in the drum cartridge 26.

The photosensitive drum 27 and the toner box 34 require large spaces relative to other components of the process unit 17. Therefore, the photosensitive drum 27 and the toner box 34 are not disposed directly above the pick-up roller 8 and the register rollers 12, which require comparatively large spaces in the vicinity of the process unit 17.

The toner box 34 is filled with toner (developing agent). The toner within the toner box 34 is agitated by rotating an agitator 36, which is supported by a rotating shaft 35 arranged at a substantially central portion of the toner box 34, in the clockwise direction, as indicated by the arrow in FIG. 1. The agitated toner is discharged from a toner supply port 37 formed in the toner box 34.

The toner supply roller 33 is arranged to the side of the toner supply port 37, so as to rotate in a counterclockwise direction. The developing roller 31 is disposed in confrontation with the toner supply roller 33, so as to rotate in a counterclockwise direction. The toner supply roller 33 and the developing roller 31 contact each other so as to apply some pressure to each other.

The toner supply roller 33 includes a metal roller shaft covered by a roller portion formed of, for example, conductive foam. The developing roller 31 includes a metal roller shaft covered by a roller portion formed, for example, of a conductive rubber material having no magnetic characteristics. The roller portion of the developing roller 31 may be formed of conductive urethane rubber or silicone rubber including fine carbon particles. A surface of the roller portion of the developing roller 31 may be coated with urethane rubber or fluorinated silicone rubber. A developing bias is applied to the developing roller 31.

The layer thickness regulating blade 32 is arranged in the vicinity of the developing roller 31. The layer thickness regulating blade 32 includes a blade body formed of metal plate spring and a pressing portion 40 disposed at an end of the blade body and formed of insulating silicone rubber into a substantially semicircular shape in cross section. The layer thickness regulating blade 32 is supported by the developing cartridge 28 near the developing roller 31. The pressing portion 40 presses the surface of the developing roller 31 with the elasticity of the blade body.

The toner discharged from the toner supply port 37 is supplied to the developing roller 31 by the rotation of the toner supply roller 33. At this time, the toner is positively frictionally charged between the toner supply roller 33 and the developing roller 31. The toner supplied onto the developing roller 31 enters between the pressing portion 40 of the layer thickness regulating blade 32 and the developing roller 31, as the developing roller 31 is rotated. The toner is further sufficiently frictionally charged and is carried onto the developing roller 31 as a thin layer having a constant thickness.

The photosensitive drum 27 is arranged to the side of the developing roller 31 in confrontation with the developing roller 31, so as to rotate in a clockwise direction. A drum body of the photosensitive drum 27 is grounded and its surface is formed of a positively chargeable photosensitive layer including, for example, polycarbonate. The photosensitive drum 27 is rotated by a drive force from a main motor (not shown).

The scorotron charger 29 is disposed at a predetermined distance from the photosensitive drum 27, to prevent the charger 29 from contacting the photosensitive drum 27. The scorotron charger 29 is arranged, for example, about 30 degrees above horizontal with respect to a location of the photosensitive drum 27. The charger 29 is a positively charging scorotron charger that generates corona discharge from, for example, a tungsten wire. The scorotron charger 29 uniformly and positively charges the surface of the photosensitive drum 27.

The surface of the photosensitive drum 27 is first charged uniformly and positively by the scorotron charger 29 while the photosensitive drum 27 is rotated. Thereafter, the surface of the photosensitive drum 27 is selectively exposed to the laser beam emitted from the scanner unit 16, which scans across the surface of the drum 27 at high speed. Thus, an electrostatic latent image, based on predetermined image data, is formed on the surface of the photosensitive drum 27.

Thereafter, as the toner, which is carried on the developing roller 31 and is positively charged, is brought into confrontation with the photosensitive drum 27 in accordance with the rotation of the developing roller 31, the toner is supplied to the electrostatic latent image on the surface of the photosensitive drum 27. That is, toner adheres to parts of the surface of the photosensitive drum 27 selectively exposed to the laser beam, where the potential level is lower than the remaining parts of the surface of the photosensitive drum 27. Thus, the electrostatic latent image on the photosensitive drum 27 is made visible to complete a reverse image developing.

The transfer roller 30 is arranged below the photosensitive drum 27 so as to face the photosensitive drum 27. The transfer roller 30 is rotatably supported by the drum cartridge 26 so as to be able to rotate in a counterclockwise direction. The transfer roller 30 includes a metal roller shaft covered by a roller portion formed of, for example, an ionic conductive rubber material. A transfer bias (transfer forward bias) is applied to the transfer roller 30 during transfer of the toner onto the sheet 3. The visible toner image carried onto the surface of the photosensitive drum 27 is transferred onto the sheet 3 while the sheet 3 passes the image forming position P between the photosensitive drum 27 and the transfer roller 30.

The fixing unit 18 is arranged downstream of the process unit 17 in the sheet feeding direction behind the process unit 17. The fixing unit 18 includes the heat roller 41 formed with a gear, a pressing roller 42 that presses the heat roller 41, and a thermostat 18*a*. The heat roller 41 and the thermostat 18*a* are covered with a cover 18*b*.

The heat roller 41 may be formed of metal and provided with a halogen lamp as a heat source. The pressing roller 42 has a spring 42*a* that rotatably presses or urges the pressing roller 42 from below toward a rotating axis of the heat roller 41. The pressing roller 42 makes close contact with the heat roller 41 or the sheet 3 and rotates in synchronization with the heat roller 41.

The thermostat 18*a* is, for example, a bimetal thermostat. The thermostat 18*a* turns a power source of a heater for heating the heat roller 41 on or off, in accordance with detected heat generated by the heat roller 41, to prevent the heat roller 41 from being heated to an extraordinarily high temperature.

The thermostat 18*a* is arranged above the heat roller 41 on an extension line (virtual line) connecting a rotating axis (not shown) of the pressing roller 42 and a rotating axis (not shown) of the heat roller 41. Therefore, the position of a deep portion 46*a* of the discharge tray 46 can be disposed lower, in comparison with cases where the thermostat 18*a* is arranged just above the heat roller 41 or on the rear side with respect to the position just above the heat roller 41 toward the downstream side in the sheet feeding direction (left side in FIG. 1).

The cover 18*b* has a shape that covers the side and the upper portion of the heat roller 41, to prevent heat generated by the heat roller 41 in the fixing unit 18 from being discharged out of the unit 18 and adversely affecting other units or devices, such as the scanner unit 16, disposed within the main casing 2. The cover 18*b* supports the rotating axis of the pressing roller 42 so that the pressing roller 42 can rotate and move in an urging direction of the spring 42*a*. A lower half of the pressing roller 42 is left exposed from (i.e., not covered by) the cover 18*b*. Therefore, as compared with a printer that includes a cover that covers a lower portion of a pressing roller as well an upper portion, the height of the printer 1 can be reduced in an amount corresponding to the thickness of such a cover.

In the fixing unit 18, the heat roller 41 fixes the toner transferred onto the sheet 3 in the process unit 17, while the sheet 3 passes between the heat roller 41 and the pressing roller 42, by the application of heat and pressure. Further, the heat roller 41 feeds the sheet 3 having an image fixed thereon to discharge rollers 45, through a discharge path formed by guide members 52, 53. The discharge rollers 45 discharge the sheet 3 onto the discharge tray 46. A pair of discharge rollers 45 is disposed near a discharge port 24 for discharging the sheet 3 from the printer 1.

If the sheet 3 subjected to heat application by the heat roller 41 is suddenly or sharply bent, the bent sheet 3 may not return to its original unbent state. Therefore, the guide members 52, 53, which the sheet 3 contacts after passing the heat roller 41, are formed such that the sheet 3 is gently bent in a heat applied condition immediately after passing the heat roller 41 and more severely bent as the sheet 3 approaches the discharge rollers 45.

With such a structure, the position of the discharge port 24 can be placed lower, as compared with a case where the entire discharge path of the sheet 3 is gently curved. Accordingly, the height of the printer 1 can be readily reduced while permanent bending of the sheet 3 is prevented.

The discharge tray 46 has a gradual downward slope from the front side of the printer 1 to the rear side (left side in FIG. 1). The deep portion 46*a* of the discharge tray 46 is set lower than the upper end of the fixing unit 18. Therefore, the discharge rollers 45 can be disposed at relatively lower positions without reducing the number of the sheets 3 that can be stacked in the discharge tray 46. Thus, the height of the printer 1 at a position where the scanner unit 16 is disposed and the height of the printer 1 at a position where the discharge rollers 45 are disposed, can be brought closer to each other. Therefore, the printer 1 can have a good design and appearance.

A top cover 2*c* including the discharge tray 46 is arranged on a top face 2*b* of the printer 1. The discharge tray 46 has a curved portion 46*c* curved upward toward the front side, a flat portion 46*b* connected to a front end of the curved portion 46*c*, and a deep portion 46*a* connected to a rear end of the curved portion 46*c*.

As shown by the broken line in FIG. 1, a circuit board 90 is arranged on at least one side face of the sheet feed path, the circuit board 90 mounting the controller for performing control of driving components of the printer 1, such as the rollers and the polygon mirror 19.

Figure 2:
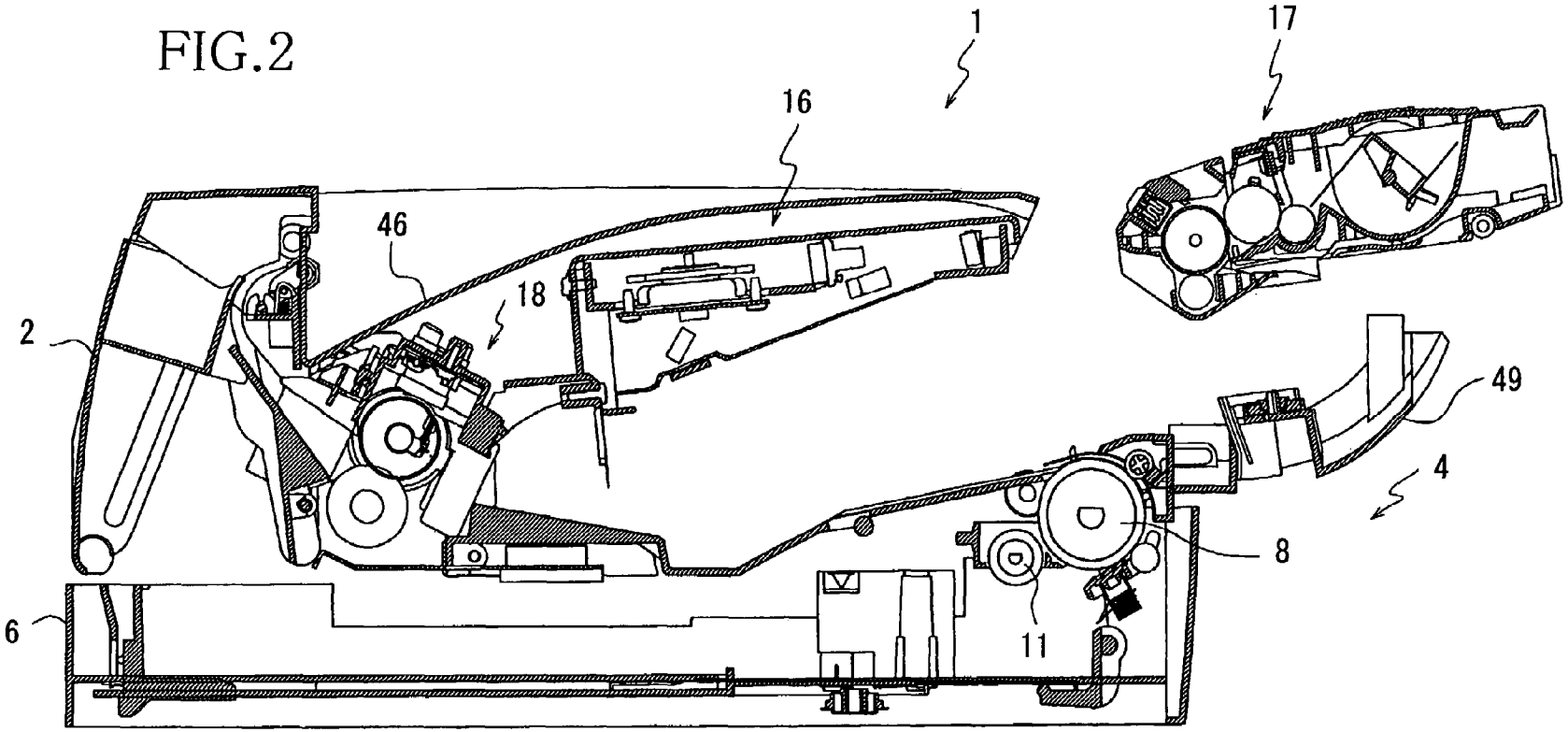
FIG. 2 is a side cross sectional view of an exemplary image forming apparatus according to this invention in which an exemplary process unit has been removed.

Removal of the process unit 17 by a user is described with reference to FIGS. 2 and 3. When the process unit 17 is removed from the printer 1 in the state shown in FIG. 1, the user first opens the front cover 49 of the printer 1 toward the front side thereof, as shown in FIG. 2. At this time, the front cover 49 pivots about a support shaft 49*z*. The support shaft 49*z* is located above the sheet cassette 6.

71 With the front cover 49 open, the process unit 17 in the state of FIG. 1 is pulled out toward the front side of the printer 1 in a substantially horizontal direction (removing direction). The process unit 17 passes over the pick-up roller as it is removed from the printer 1. As described above, a space is formed between the process unit 17 and the scanner unit 16 when the process unit 17 is installed in the printer 1. Therefore, the process unit 17 can be removed from the main casing 2 by pulling a handle 17*a* (shown in FIG. 1) located on the front side of the process unit 17 (side near the pick-up roller 8) toward the scanner unit 16. With such a structure, the rear side of the process unit 17 (image forming position P side) is not likely to be caught in the printer 1. Thus, the process unit 17 can be smoothly pulled out from the printer 1.

Figure 3:
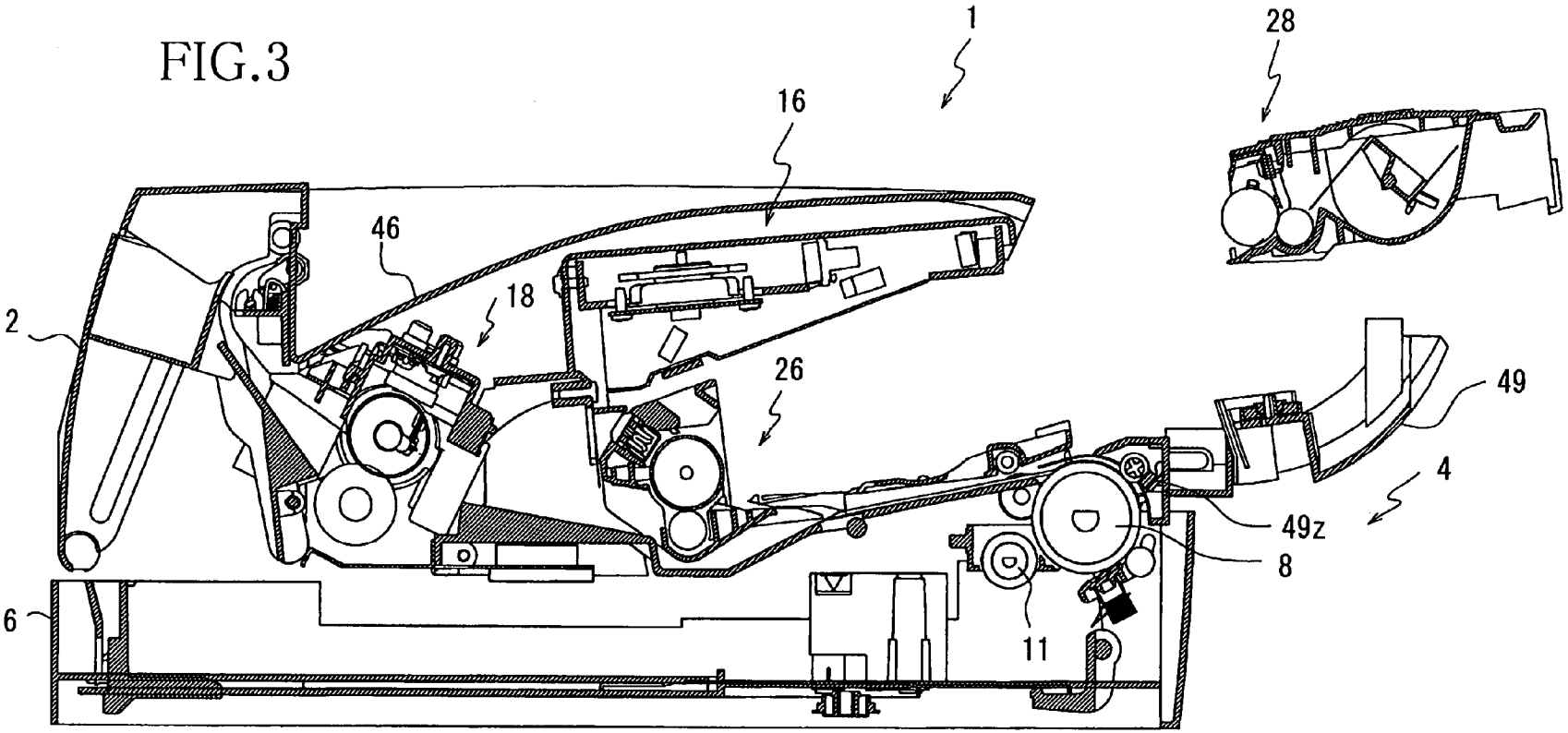
FIG. 3 is a side cross sectional view of an exemplary image forming apparatus according to this invention in which an exemplary developer cartridge of an exemplary process unit has been removed.

As shown in FIG. 3, it is possible to remove only the developing cartridge 28 from the printer 1, while the drum cartridge 26 of the process unit 17 remains installed in the printer 1.

The above-described printer 1 includes the sheet cassette 6, the sheet feed path, the pick-up roller 8, the process unit 17, and the scanner unit 16. The sheet cassette 6 is capable of storing a stack of the sheets 3 at a lower portion of the printer 1. Provided above the sheet cassette 6 is the sheet feed path along which the sheet 3 stored in the sheet cassette 6 is discharged from the printer 1, via the image forming position P. The pick-up roller 8, which is located above one end portion of the sheet cassette 6, feeds the uppermost sheet 3 in the sheet cassette 6 to the sheet feed path. The process unit 17 disposed near the pick-up roller 8 above the sheet cassette 6 includes the photosensitive drum 27 and the toner box 34 capable of containing the toner. When the process unit 17 is taken out of the printer 1, the process unit 17 can be moved substantially horizontally in the removing direction while passing over the pick-up roller 8. The scanner unit 16 is arranged above the process unit 17 and includes at least the polygon mirror 19.

The scanner unit 16 is formed in a tapered shape having a smaller thickness on the pick-up roller 8 side in the removing direction, to allow the process unit 17 to be removed from the main casing 2. A part of the sheet feed path is formed in an area defined by the process unit 17 and the sheet cassette 6. The image forming position P located on the sheet feed path is disposed lower than the upper end of the pick-up roller 8.

With such a structure, the process unit 17 can be easily taken out of the printer 1. Further, since the scanner unit 16 is formed in a tapered shape having a smaller thickness in the area above the pick-up roller 8, the height of the printer 1 at the position of the pick-up roller 8 can be reduced in comparison with a case where the scanner unit 16 is not formed in a tapered shape.

The position of the process unit 17 in the printer 1 can be lowered by the amount that the image forming position P is lowered with respect to the upper end of the pick-up roller 8. Thus, the height of the printer 1 at the image forming position P can be reduced.

As the process unit 17 has the photosensitive drum 27 and the transfer roller 30, the photosensitive drum 27 and the transfer roller 30 can be replaced when the process unit 17 is replaced.

The scanner unit 16 has upper and lower plates forming an external wall. The lower plate is more inclined than the upper plate with respect to horizontal. Thus, the height of the printer 1 in the vicinity of the pick-up roller 8 can be reduced.

The scanner unit 16 includes the motor 25 for rotating the polygon mirror 19, and the reflecting mirrors 22, 23 for sequentially reflecting the laser beam scanned by the polygon mirror 19 to guide the laser beam to the photosensitive drum 27. The reflecting mirror 22 for first reflecting the laser beam is located in the scanner unit 16 at a position near the front cover 49 in the direction that the process unit 17 is removed from the printer 1. The polygon mirror 19, the polygon motor 25 and the reflecting mirror 23 for subsequently reflecting the laser beam are located in the scanner unit 16 at a position away from the front cover 49 in the direction that the process unit 17 is removed from the printer 1.

Accordingly, the height of the printer 1 in the vicinity of the pick-up roller 8 can be reduced since the scanner unit 16 is formed in a tapered shape having a smaller thickness on the pick-up roller 8 side. Further, since the sheet feed path is continuously downwardly inclined over the entire interval from the upper end of the pick-up roller 8 to the image forming position P, an area above the sheet feed path between the pick-up roller 8 and the image forming position P can be effectively used, and in turn, the size of the printer 1 can be reduced.

The photosensitive drum 27 and the toner box 34 of the process unit 17 are arranged in the area above the pick-up roller 8 on the image forming position P side of the register rollers 12. The photosensitive drum 27 and the toner box 34 are disposed so as not to overlap with the pick-up roller 8 or the register rollers 12. Accordingly, by ensuring sufficient space for the photosensitive drum 27 and the toner box 34, the printer 1 can be reduced in size without reducing the sizes of the photosensitive drum 27 and the toner box 34.

In addition, the scanner unit 16 is arranged on a side away from the front cover 49 in the direction that the process unit 17 is installed in the printer 1. Because the scanner unit 16 is disposed so as not to overlap with the pick-up roller 8, the height of the printer 1 at the position of the pick-up roller 8, can be reduced.

Disposed in the sheet feed path are the heat roller 41 for fixing the toner transferred to the sheet 3, the discharge rollers 45 arranged near the discharge port 24 for discharging the sheet 3 from the printer 1 positioned between the heat roller 41 and the discharge port 24, and the guide members 52, 53 for guiding the sheet 3 between the heat roller 41 and the discharge rollers 45. The interval from the heat roller 41 to the discharge rollers 45 is shorter than a minimum length of the sheet 3 in the sheet feeding direction.

Since the printer 1 has no rollers between the heat roller 41 and the discharge rollers 45, space that would have been occupied by such rollers is saved and, in turn, the size of the printer 1 can be reduced.

The guide members 52, 53 forming the sheet feed path are configured so that the curvature of the guide member 53 in the vicinity of the discharge rollers 45 is greater than the curvature of the guide member 52 in the vicinity of the heat roller 41. Accordingly, positions of the discharge rollers 45 can be lowered, while preventing the sheet 3 from being bent.

The sheet feed path is formed in a substantially "S" shape when viewed from the axial direction of the pick-up roller 8 (e.g., as viewed in FIG. 1), so as to turn the sheet 3 in the vicinity of the pick-up roller 8 and to again turn the sheet 3 downstream of the image forming position P in the sheet feeding direction. By employing such a structure, a long sheet feed path can be formed relative to the size of the printer 1. Thus, components of the printer 1 that are to be disposed in the vicinity of the sheet feed path can be efficiently arranged.

The discharge tray 46 is provided with the deep portion 46*a* so as to situate a bottom surface of the discharge tray 46 nearest to the discharge port 24 lower than the upper face of the fixing unit 18. Thus, the area near the heat roller 41 can be effectively used and the position of the discharge port 24 can be lowered. Consequently, the height of the printer 1 in the vicinity of the discharge port 24 can be reduced.

The pressing roller 42 is disposed at a position shifted away from the pick-up roller 8, rather than in a position immediately below the heat roller 41. The thermostat 18*a* is disposed on a plane perpendicular to a plane encompassing the rotating axes of the heat roller 41 and the pressing roller 42. By employing such a structure, the height of the printer 1 can be further reduced since the position of the deep portion 46*a* of the discharge tray 46 can be lowered. Further, since the fixing unit 18 is arranged along the curve of the discharge tray 46, space within the printer 1 can be effectively used.

The cover 18*b* covers the thermostat 18*a* and the heat roller 41 of the fixing unit 18, while leaving the pressing roller 42 exposed. By employing such a structure, the cover 18*b* is does not cover a lower portion of the fixing unit 18. Thus, the height of the printer 1 can be reduced in an amount corresponding to the space that would have been used if the cover 18*b* also covered the lower portion of the fixing unit 18.

Further, the circuit board 90 including electronic circuits for electrically controlling the units or components of the printer 1 is disposed in the printer 1 on a vertical plane parallel to the direction that the process unit 17 is installed in and removed from the printer 1 (i.e., on the front and rear sides of the sheet feed path when viewed from the axial direction of the pick-up roller 8). Accordingly, the thickness of the circuit board 90 is not reflected in the height of the printer 1. Thus, the height of the printer 1 can be reduced as compared with a case in which the circuit board 90 is arranged substantially horizontally.

Further, since the scorotron charger 29 for charging the photosensitive drum 27 is arranged so as to charge the photosensitive drum 27 at a position, for example, approximately 45 degrees from horizontal with respect to the photosensitive drum 27, the scorotron charger 29 is not likely to project upward from the upper end of the photosensitive drum 27. Hence, the position of the scorotron charger 29 is not likely to be reflected in the height of the printer 1.

The printer 1 includes the ejection roller 11 that conveys the sheet 3 stacked on the sheet cassette 6 to a position where the pick-up roller 8 feeds the sheet 3, and the separation pad 9 arranged near the position where the pick-up roller 8 feeds the sheet 3 that ensures that only the uppermost sheet 3 in the sheet cassette 6 is fed when plural sheets 3 are supplied by the ejection roller 11, by contacting the sheets 3. By employing such a structure, the ejection roller 11 reduces the load applied to the separation pad 9 so that wear of the separation pad 9 and the sheet 3 can be prevented.

Those skilled in the art will recognize that there are many possible modifications and variations within the scope of the invention. For example, in the above-described embodiment, the printer 1 forms an image on the sheet 3. However, an image may be formed on an OHP sheet or cloth. Also, although the thermostat 18*a* is used to prevent the heat roller 41 from being overheated in various embodiments described above, a temperature sensor may be used instead of the thermostat 18*a*.

While this invention has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. An image forming apparatus, comprising:

a main casing;

a photosensitive member;

a process cartridge that can be installed or removed with respect to the main casing along a removal path, the process cartridge including a developer accommodating portion that can accommodate a developer;

a scanner unit located above the process cartridge when the process cartridge is installed in the main casing, the scanner unit being capable of irradiating a surface of the photosensitive member with a laser beam;

a sheet accommodating portion located at a bottom portion of the main casing, the sheet accommodating portion being capable of accommodating a sheet;

a pick-up roller located above the sheet accommodating portion, the pick-up roller being capable of drawing the sheet from the sheet accommodating portion; and a feed path along which the sheet can be conveyed from the sheet accommodating portion to a discharge port;

wherein:

at least a part of the feed path is substantially parallel to the removal path and located between the sheet accommodating portion and the process cartridge when the process cartridge is installed in the main casing;

the scanner unit includes a frame including a first portion having a first height and a second portion having a second height that is less than the first height, the second portion being located closer to the pick-up roller than the first portion; and an image forming position where an image is transferred from the photosensitive member to the sheet is located along the feed path at a position lower than an upper surface of the pick-up roller in a vertical direction.

2. The image forming apparatus according to claim 1, wherein:

the process cartridge includes the photosensitive member and a transfer roller;

a peripheral surface of the transfer roller faces the photosensitive member; and the image forming position is located between the photosensitive member and the transfer roller.

3. The image forming apparatus according to claim 1, wherein the frame of the scanner unit includes an upper plate and a lower plate, the lower plate being inclined from horizontal at a greater angle than the upper plate.

4. The image forming apparatus according to claim 3, wherein the frame of the scanner unit includes a front wall and a rear wall, the rear wall having a greater height than the front wall.

5. The image forming apparatus according to claim 4, wherein the scanner unit includes:

a laser diode capable of emitting the laser beam;

a polygonal mirror capable of reflecting the laser beam emitted by the laser diode;

a motor capable of rotating the polygonal mirror;

a first mirror capable of reflecting the laser beam reflected by the polygonal mirror; and a second mirror capable of reflecting the laser beam reflected by the first mirror;

wherein:

the first mirror is located closer to the front wall than to the rear wall; and the second mirror, the polygonal mirror and the motor are located closer to the rear wall than to the front wall.

6. The image forming apparatus according to claim 1, wherein the feed path is inclined downwardly with respect to horizontal from the upper surface of the pick-up roller to the image forming position.

7. The image forming apparatus according to claim 1, wherein, when installed, the process cartridge is located on the removal path closer to the image forming position than to a position directly above the pick-up roller.

8. The image forming apparatus according to claim 1, further comprising a register roller for correcting skew of the sheet, the register roller being located on the feed path between the pick-up roller and the image forming position;

wherein, when installed, the process cartridge is located on the removal path closer to the image forming position than to a position directly above the register roller.

9. The image forming apparatus according to claim 1, wherein the scanner unit is located on the removal path at a position closer to the image forming position than to a position directly above the pick-up roller.

10. The image forming apparatus according to claim 1, wherein:

a heat roller, a discharge roller and a guide are provided along the feed path;

the heat roller is capable of heating the developer after the developer is transferred onto the sheet;

the discharge roller is capable of discharging the sheet from the image forming apparatus through the discharge port, the discharge roller being located near the discharge port; and the guide is capable of guiding the sheet along an interval of the feed path between the heat roller and the discharge roller, the interval being shorter in length than a minimum length of the sheet in a direction along which the sheet is fed.

11. The image forming apparatus according to claim 10, wherein:

the guide includes a first curved portion and a second curved portion for turning the sheet after the sheet has passed the heat roller;

a first curvature of the first curved portion is greater than a second curvature of the second curved portion; and the second curved portion is closer to the heat roller than the first curved portion.

12. The image forming apparatus according to claim 1, wherein the feed path includes a first turn at the pick-up roller and a second turn downstream of the image forming position.

13. The image forming apparatus according to claim 1, wherein:

the image forming apparatus further comprises a fixing unit including a heat roller that is capable of heating the developer after the developer is transferred onto the sheet;

the discharge port is configured such that the sheet can be discharged through the discharge port after the developer is fixed onto the sheet by the fixing unit, the discharge port being located on an upper portion of the image forming apparatus; and the image forming apparatus further comprises a sheet stacking portion on which the sheet can be stacked after the sheet is discharged through the discharge port, the sheet stacking portion including a recess such that a bottom surface of the sheet stacking portion at a position adjacent to the discharge port is lower than an upper surface of the fixing unit.

14. The image forming apparatus according to claim 13, wherein the fixing unit further includes:

a heating element that is heated by a power application;

a switching device that switches off the power application to the heating element at a predetermined temperature, the switching device being disposed above the heat roller; and a pressing roller that is pressed toward a rotating axis of the heat roller, the pressing roller being located to a side of a position directly below the heat roller, the position directly below the heat roller being located between the side and the pick-up roller;

wherein the switching device is located substantially in a first plane, the first plane being perpendicular to a second plane including the rotating axis of the heat roller and a rotating axis of the pressing roller.

15. The image forming apparatus according to claim 14, wherein:

the fixing unit includes a cover that covers the heat roller and the switching device while leaving the pressing roller exposed; and the cover supports the switching device.

16. The image forming apparatus according to claim 1, further comprising a circuit board that electrically controls components of the image forming apparatus, the circuit board including an electronic circuit mounted thereon;

wherein the circuit board is disposed at one side of the image forming apparatus substantially in a vertical plane, the vertical plane being perpendicular to a plane including a rotating axis of the photosensitive member and a rotating axis of the pick-up roller.

17. The image forming apparatus according to claim 1, further comprising a charger provided on the process cartridge, wherein:

the photosensitive member has a cylindrical shape having an axis extending in a direction perpendicular to the removal path; and the charger is located at about 45 degrees from horizontal with respect to the photosensitive member.

18. The image forming apparatus according to claim 1, further comprising:

an ejection roller that ejects the sheet when the sheet is accommodated in the sheet accommodating portion to a position where the pick-up roller is capable of drawing the sheet; and a separation pad that contacts the sheet when the sheet is conveyed from the ejection roller to the pick-up roller to prevent multiple sheets from being drawn by the pick-up roller, the separation pad being located near the position where the pick-up roller is capable of drawing the sheet.

19. An image forming apparatus, comprising:

a sheet accommodating portion located at a bottom portion of a main casing of The image forming apparatus, the sheet accommodating portion being capable of accomodating a sheet;

a feed path along which the sheet can be conveyed from the sheet accommodating portion and a process cattridge when the process cartridge is installed in the amin casing;

a fixing unit including a heat roller that is capable of heating a developer after the developer is transferrde onto the sheet;

the discharge port through which the sheet can be discharged after the developer is fixed onto the sheet by the fixing unit, the discharge port being located on an upper portion of the image forming apparatus; and a sheet stacking portion on which the sheet can be stacked after the sheet is discharged through the discharge port;

wherein the sheet stacking portion includes a recess such that a bottom surface of the sheet stacking portion at a position adjacent to the discharge port is lower than an upper surface of the fixing unit, wherein:

the heat roller, a discharge roller and a guide are provided along the feed path;

the guide includes a first curved portion and a second curved portion for turning the sheet when the sheet has passed the heat roller;

a first curvature of the first curved portion is greater than a second curvature of the second curved portion; and the second curved portion is closer to the heat roller than the first curved portion.

20. The image forming apparatus according to claim 19, wherein:

the heat roller, a discharge roller and a guide are provided along the feed path;

the discharge roller is capable of discharging the sheet from the image forming apparatus through the discharge port, the discharge roller being located near the discharge port; and the guide is capable of guiding the sheet along an interval of the feed path between the heat roller and the discharge roller, the interval being shorter in length than a minimum length of the sheet in direction along which the sheet is fed.

21. The image forming apparatus according to claim 19, wherein the fixing unit includes:

a heating element that is heated by a power application;

a switching device that switches off the power application to the heating element at a predetermined temperature, the switching device being disposed above the heat roller; and a pressing roller that is pressed toward a rotating axis of the heat roller, the pressing roller being located to a side of a position directly below the heat roller, the position directly below the heat roller being located between the side and the pick-up roller;

wherein the switching device is located substantially in a first plane, the first plane being perpendicular to a second plane including the rotating axis of the heat roller and a rotating axis of the pressing roller.

22. The image forming apparatus according to claim 19, wherein:

the fixing unit includes a cover that covers the heat roller and the switching device while leaving the pressing roller exposed; and the cover supports the switching device.

* * * * *